US007492266B2

(12) United States Patent
Bhavani

(10) Patent No.: US 7,492,266 B2
(45) Date of Patent: Feb. 17, 2009

(54) SYSTEMS AND METHODS FOR LOCATING HOSPITAL ASSETS

(75) Inventor: Neeraj Bhavani, Ladera Ranch, CA (US)

(73) Assignee: Tagnos, Inc., Ladera Ranch, CA (US)

( * ) Notice: Subject to any disclaimer, the term of this patent is extended or adjusted under 35 U.S.C. 154(b) by 291 days.

(21) Appl. No.: 11/381,060

(22) Filed: May 1, 2006

(65) Prior Publication Data

US 2007/0252695 A1 Nov. 1, 2007

(51) Int. Cl.
*G08B 13/14* (2006.01)

(52) U.S. Cl. ..... 340/572.4; 340/539.13; 340/825.49; 455/457

(58) Field of Classification Search ..... 340/572.1, 340/572.4, 573.1, 573.4, 539.1, 539.11, 539.13, 340/825.49, 5.92, 5.82; 705/28; 235/385; 342/357.06, 450

See application file for complete search history.

(56) References Cited

U.S. PATENT DOCUMENTS 6,012,029 A * 1/2000 Cirino et al. ..... 704/275
6,466,125 B1 * 10/2002 Richards et al. ..... 340/573.4
6,600,418 B2 7/2003 Francis et al.
6,650,225 B2 11/2003 Bastian, II et al.
6,816,075 B2 11/2004 Grunes et al.
6,996,538 B2 2/2006 Lucas
2005/0200478 A1 * 9/2005 Koch et al. ..... 340/539.13
2006/0158329 A1 * 7/2006 Burkley et al. ..... 340/539.13
2006/0181424 A1 * 8/2006 Graves et al. ..... 340/573.1

OTHER PUBLICATIONS informationweek.com / Cisco Combines RFID Location Tools With W-Fi, Loring Wirbel, no date.
Exavera.com / Exavera's eShepard combines RFID and 802.11a/b/g (Wireless LAN) technologies to provide location and identification services and optimize hospital workflow, no date.

* cited by examiner

*Primary Examiner*—Thomas J Mullen
(74) *Attorney, Agent, or Firm*—Fish & Associates, PC

(57) ABSTRACT

A VoIP communicator utilizes an ultrawide band frequency, sufficient to determine a location of the communicator to within 1 meter, 0.1 meters, or less. The communicator preferably includes a display screen that displays a rich colored asset map. Several novel software functionalities are contemplated, including: (a) reporting the location of the responder as being within one of a plurality of business locations; (b) using scalar vector graphics to display the locations with varying degrees of detail; (c) displaying replay of movements of the assets; (d) displaying utilization profiles of the assets; and (e) coordinating the locations of the at least some of the assets data from a global satellite positioning system (GPS). It is still further contemplated that the inventive system can consolidates output from different types of nominally incompatible equipment.

25 Claims, 4 Drawing Sheets

SYSTEMS AND METHODS FOR LOCATING HOSPITAL ASSETS

FIELD OF THE INVENTION

The field of the invention is hospital asset management systems.

BACKGROUND

Hospitals have a large number of mobile physical assets, including gurneys, diagnostic equipment, treatment equipment, bandages and other supplies, drugs, and so forth, as well as physicians, nurses and other personnel that can also be considered mobile assets. Problems arise because it is extremely difficult to keep track of such assets, and it is even more difficult to identify needed assets that may be nearby, but are in a different room, cabinet, or are otherwise hidden from view.

It is known that Radio Frequency Identification Tags (RFID tags) can be used to keep tabs on the locations of equipment, supplies, and so forth, and location information using RFID tags can be quite accurate, down to a few centimeters. It is, however, problematic that RFID tags are usually active over only a very short distance, and therefore commonly require nearby interrogators.

One solution is to distribute a very large number of interrogators within the workspace. In a recent example, Cisco™ announced its Wireless Location Appliance™ 2700, which uses WiFi access points to gather signal strength indicators from 802.11 devices and tags, and triangulates the information to roughly determine the locations of the devices. (See, e.g. http://informationweek.com/story/showArticlejhtml?articleID=162101504). Unfortunately, such systems are problematic because the granularity is poor. Location information is typically accurate only within about 10 meters.

The Cisco™ article, and all other referenced citations are incorporated herein as though fully set forth in this application. Furthermore, where a definition or use of a term in a reference, which is incorporated by reference herein is inconsistent or contrary to the definition of that term provided herein, the definition of that term provided herein applies and the definition of that term in the reference does not apply.

Another solution is to integrate data captured by separate systems for RFID tag and WiFi technologies. Exavera's™ eShepherd™ operates in that manner, see, e.g. http://www.exavera.com/secure/eShepherd_Overview.pdf. That concept was also described in US patent application publication no. 2004/0217864. In both instances it is contemplated that the devices that interact using RFID tag and WiFi technologies are separate devices. Thus, a doctor may carry a Voice Over Internet Protocol (VoIP) device that provides a signal that can be triangulated using WiFi technologies, and (s)he may carry an RFID access card that is active over only a few centimeters.

A significant problem remains, therefore, that one must trade off accuracy in determining locations with closeness of the monitoring equipment. In a large environment such as a hospital, that tradeoff is unsatisfactory. What is needed are systems and methods that combine RFID and WiFi triangulation technologies in the same device.

SUMMARY OF THE INVENTION

The present invention provides apparatus, systems, and methods in which a communicator comprises a circuit, a microphone, and a speaker that cooperate to perform VoIP and an active radio-frequency ID responder that utilizes an ultrawide band frequency. The term VoIP is to be interpreted here in its broadest sense, to include use of any suitable technology, including for example IP, ARP, UDP, TCP, ICMP, Telnet, TFTP, AutoIP, DHCP, HTTP, and SNMP. It is especially contemplated that communication can comply with any of the 802.11x or superseding standards.

The communicator can be quite simple, or more elaborate, such as for example including a display screen. The display is preferably uses color images, and more preferably displays output of a rich colored asset mapper. Contemplated communicators can optionally include cell phone circuitry, walkie-talkie circuitry, and other features such as a biometric scanner.

In other aspects of the inventive subject matter, a system utilizing the inventive communicators can include a processor that cooperates with the responder to determine a location of the responder to within 1 meter, and more preferably to within 0.5 meters, 0.1 meters, or less. This accuracy can be accomplished in any suitable manner, including especially use of an ultrawide band frequency.

Contemplated methods include identifying a location of an asset to a user through voice commands. For example, it is contemplated that a user can speak an identifier of the asset into a communicator, a computer system can use the identifier to select the asset from among a plurality of other assets within a class, can automatically determine the location of the asset to within 10 meters, and can cause the communicator to display information regarding the location of the asset. Such methods are especially contemplated for mobile assets such as people, equipment and supplies, and especially with respect to hospitals and large medical practices where cell phones are often jammed. In a particularly useful embodiment, a user can speak the name of a class of objects into the communicator (e.g. "I need a gurney"), and the system can determine which of the plurality of assets of the class (e.g. gurneys) is physically nearest to the user. Location can be determined in any suitable manner, including triangulating a signal from a voice communicator carried by the user. All suitable methods of triangulation are contemplated, including triangulating differential times of reception of a given signal, phase differences in reception of a given signal, and/or differential signal strength in reception of a signal.

In yet another aspect of the inventive subject matter, a system can comprise: a plurality of portable communicators, each of which includes a circuit, a microphone, and a speaker that cooperate to perform VoIP or other voice communication; a plurality of assets tagged with an active radio-frequency ID responder; and a processor that cooperates with the communicators and the responders to determine their locations to within 1 meter. The system can be implemented locally or distally to a hospital or other business. In the latter instance the system can be operated as an application service provider (ASP) or a product-as-service. Several novel software functionalities are contemplated, including: (a) reporting the location of the responder as being within one of a plurality of business locations; (b) using scalar vector graphics to display the locations with varying degrees of detail; (c) displaying replay of movements of the assets; (d) displaying utilization profiles of the assets; and (e) coordinating the locations of at least some of the assets from a global satellite positioning system (GPS). It is still further contemplated that different ones of the responders can operate with first and second different middleware, different frequencies, different types of interrogators, etc. The inventive system can consolidate output from the different types of equipment. This could be viewed as an "air-traffic controller" type of system, in that it can operate with and coordinate with a large number of different systems, some of which may be incompatible with each other.

In still other aspects, it is contemplated that at least one of the responders in a system cooperates with at least one communicator to effect voice-to-write status and voice-to-read status. For example, responders can advantageously contain memory that can store information communicated orally from a user through the communicator, and responders can contain memory that stores status information regarding one of the plurality of assets. In the latter instance, for example, a user could speak into a communicator "check status of IV pump", the query could then be interpreted by the system, the appropriate responder associated with the IV pump could be interrogated with an interrogator for the status, and the resulting information could be sent back to the communicator for display or auditory presentation.

Various objects, features, aspects and advantages of the present invention will become more apparent from the following detailed description of preferred embodiments of the invention, along with the accompanying drawings in which like numerals represent like components.

DETAILED DESCRIPTION OF THE INVENTION

Figure 1:
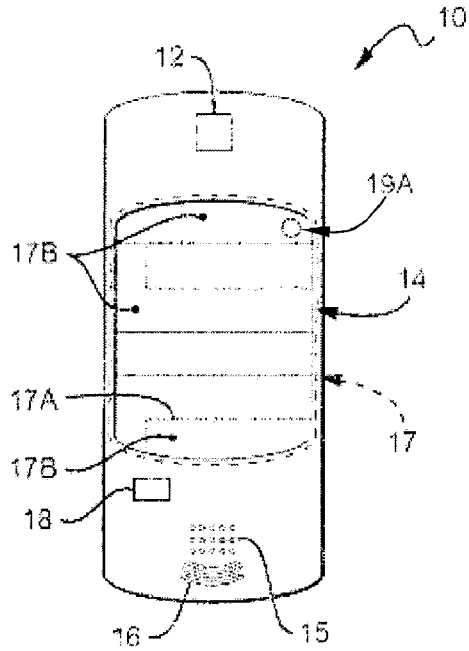
FIG. 1 is a voice communicator 10, with a RFID ultrawhite band responder 12 (tag), with a voice over IP/voice over WiFi capability.

FIG. 1 is a voice communicator 10, with a RFID ultrawhite band responder 12 (tag), with a voice over IP/voice over WiFi capability. Communicator 10 further includes a display screen 14, microphone 15, speaker 16. Rich colored asset mapper 17 includes floor plan 17A and assets 17B, and can be displayed with varying degrees of detail using software that uses scalar vector graphics 19A, a portion of which 19B can advantageously be present in a server such as server 24 (see FIG. 2). Biometric scanner 18 is adapted to read fingerprints. Other biometric scanners are contemplated, including for example iris readers, voice pattern recognizers, and so forth.

Figure 2:
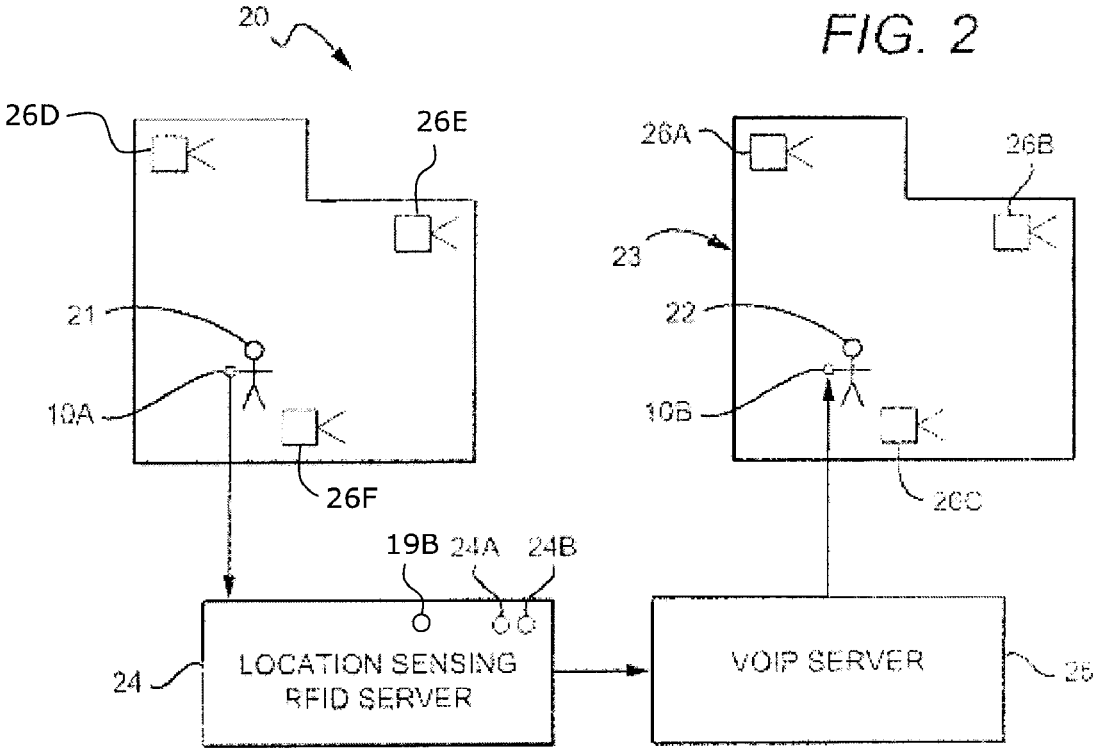
FIG. 2 is a schematic of a system 20 illustrating a doctor 21 searching for a nurse 22 near ICU room 23.

FIG. 2 is a schematic of a system 20 illustrating a doctor 21 searching for a nurse 22 near ICU room 23. The doctor 21 carries a communicator 10A and the nurse 22 carries a communicator 10B. The doctor speaks into his communicator 10A, "nurse near ICU no. 23." That message is sent to the location sensing RFID server 24, which detects a specific nurse (in this case the nurse carrying communicator 10B). The voice-over-IP server 25 puts the call from the doctor 21 into the nurse 22. Each of communicators 10A and 10B carries an RFID responder, which cooperates with RFID sensors 26A, 26B, 26C to assist in determining the location of communicator 10B. There may also be RFID sensors 26D, 26E, 26F near the doctor 21. The RFID responders and the RFID sensors 26 operate with first and second different middleware 24A on server 24, the signals of which are consolidated by software 24B operating on server 24. The doctor 21 and the nurse 22 can be in physically different business locations.

Figure 3:
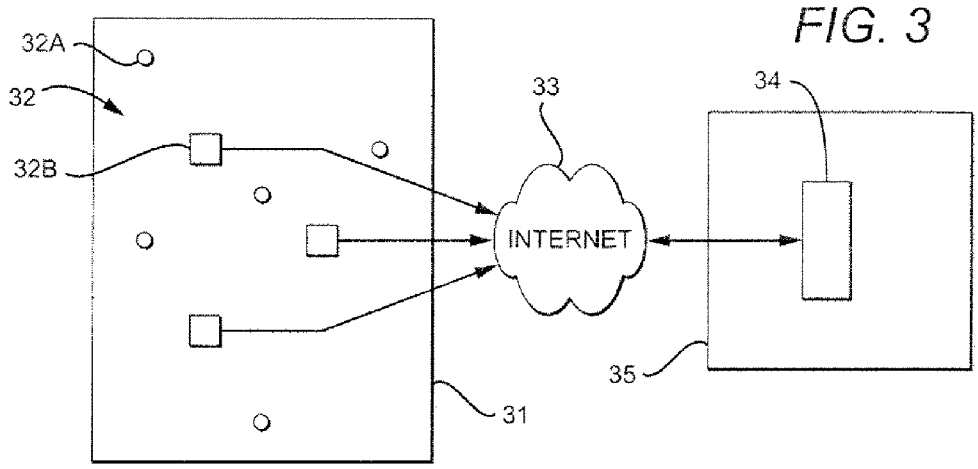
FIG. 3 is a schematic showing an ASP model view of aspects of embodiments of the present invention.

FIG. 3 is a schematic showing an ASP model view of aspects of embodiments of the present invention. Hospital or other site of business 31 includes an RFID detection system 32 (with responders 32A and interrogators 32B), which communicates through the Internet 33 with a computer 34 of a service provider 35, which executes software as described herein.

Figure 4:
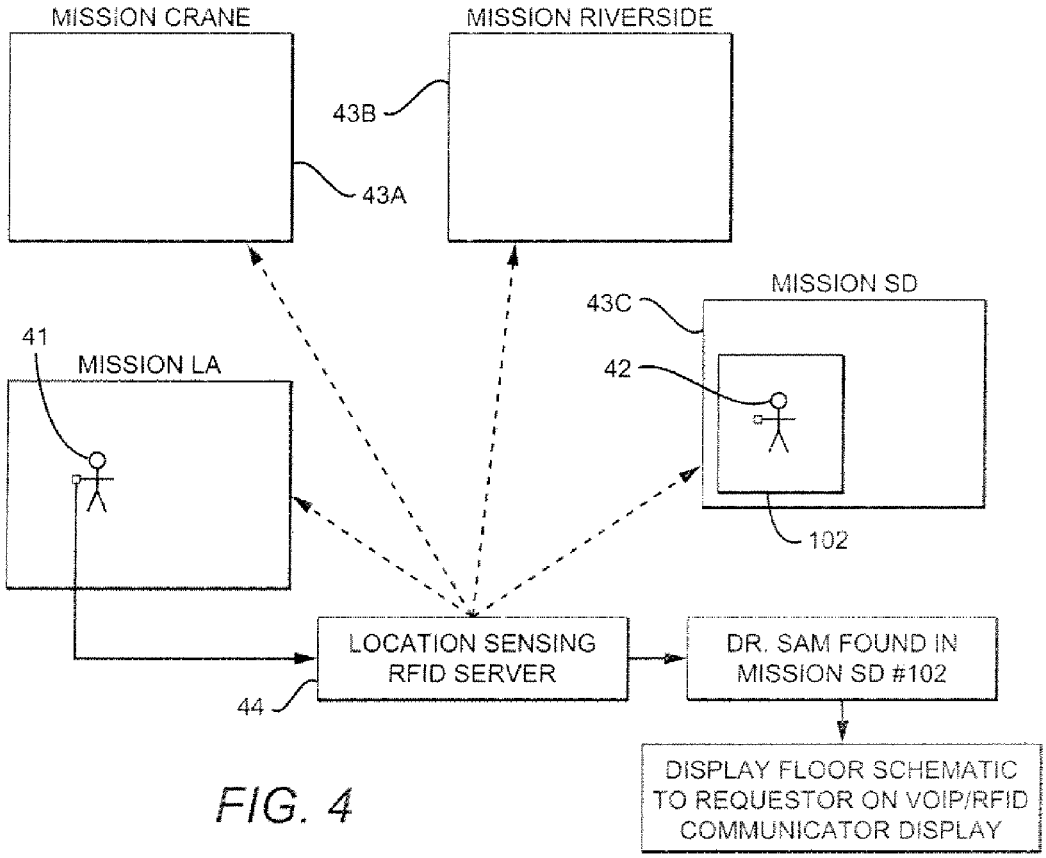
FIG. 4 is a schematic of a doctor 41 searching for an asset 42 across a plurality of separate hospital buildings 43A, 43B, and 43C.

FIG. 4 is a schematic of a doctor 41 searching for an asset 42 across a plurality of separate hospital buildings 43A, 43B, and 43C. His voice query is routed through location determining RFID server 44. The system scans all of the locations in all of the buildings, and locates the asset in building 43C. A visual representation of the corresponding floor 102 of building 43C is displayed in the visual display of the communicator of doctor 41.

Figure 5:
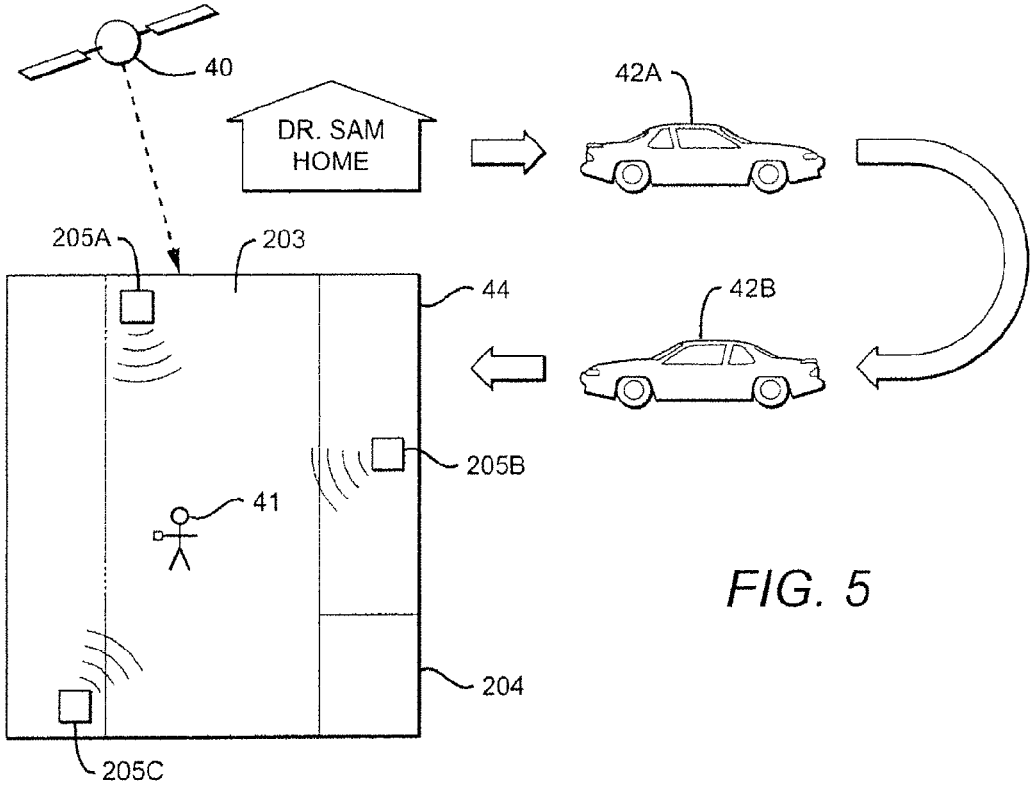
FIG. 5 is a schematic showing coordination of GPS data (from outside a hospital) with RFID ground based indoor positioning data.

FIG. 5 is a schematic showing coordination of GPS data (from outside a hospital) with RFID ground based indoor positioning data. The system includes satellite 40, a doctor 41 driving in automobile 42 at different times 42A, 42B, the doctor 41 eventually entering building 44, room 203, approaching a patient in room 204, as detected by readers 205A, 205B, 205C.

Figure 6:
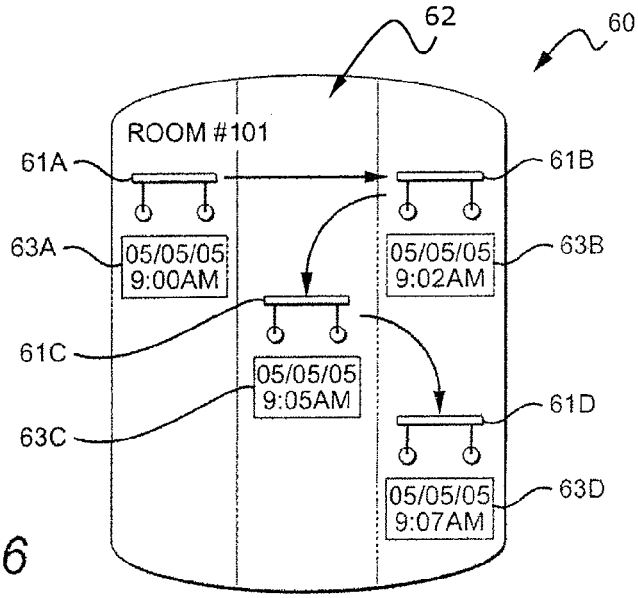
FIG. 6 is a screen shot 60 of a display of a communicator such as communicator 10.

FIG. 6 is a screen shot 60 of a display of a communicator such as communicator 10. The image on the screen includes multiple icons 61A, 61B, 61C, 61D of the same gurney (not shown) with respect to a representation 62 of a floor plan. This shows graphical replay of asset movement, to measure utilization. Times 63A, 63B, 63C, 63D can be shown on the display.

Figure 7:
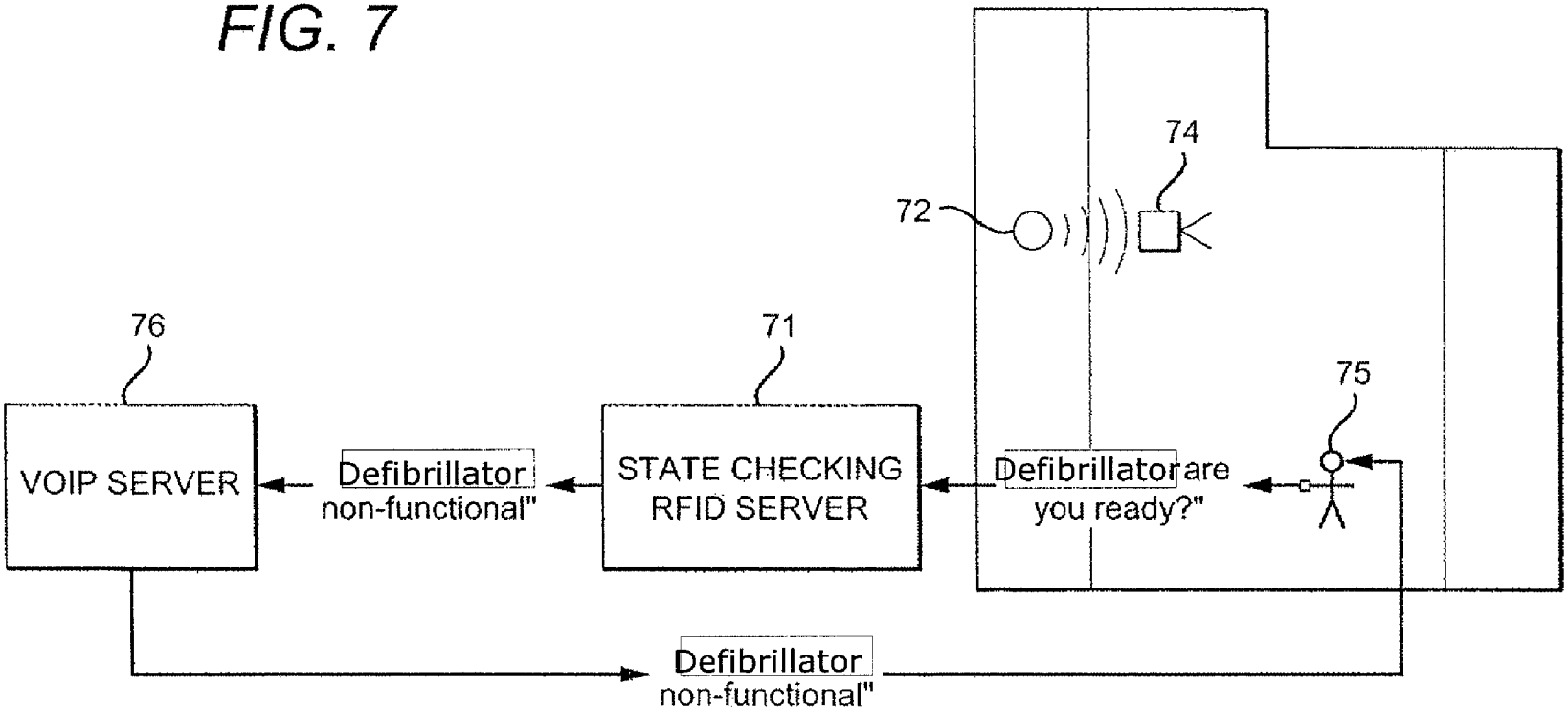
FIG. 7 is a schematic showing doctor placing information on a RFID tag using voice-to-write, and retrieving information using voice-to-read.

FIG. 7 is a schematic showing doctor placing information on a RFID tag using voice-to-write, and retrieving information using voice-to-read. These tasks are implemented in part using state checking RFID server 71, which cooperate with tag 72 and interrogator 74. Information comes back to a doctor 75 using VoIP server 76.

Thus, specific embodiments and applications of systems and methods for locating hospital assets have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A communicator comprising:

a circuit, a microphone, and a speaker that cooperate to communicate using VoIP;

an active radio-frequency ID responder that utilizes an ultrawide band frequency; and a display screen comprising an asset mapper.

2. The communicator of claim 1, further comprising software that displays scalar vector graphics on the display screen.

3. The communicator of claim 1, wherein the asset mapper is a rich colored asset mapper.

4. The communicator of claim 1, further comprising a biometric scanner.

5. A system comprising:

a portable communicator that includes a circuit, a microphone, and a speaker that cooperate to communicate using VOIP, and an active radio-frequency responder; and a processor that cooperates with the responder to determine a location of the responder to within 1 meter.

6. The system of claim 5, wherein the responder uses an ultrawide band frequency.

7. A method of identifying a location of an asset to a user, comprising:

the user speaking an identifier of the asset into a communicator;

a computer system using the identifier to select the asset from among a plurality of assets within a class, and automatically determining the location of the asset to within 10 meters; and displaying information regarding the location of the asset on the communicator.

8. The method of claim 7, wherein the asset is mobile.

9. The method of claim 7, wherein the step of speaking an identifier comprises speaking an identifier of the class.

10. The method of claim 9, further comprising the computer system determining which of the plurality of assets of the class is physically nearest to the user.

11. The method of claim 7, wherein the step of automatically determining the location comprises triangulating a signal from a voice communicator carried by the user.

12. The method of claim 7, wherein the step of automatically determining the location comprises triangulating a signal from a voice communicator.

13. A system comprising:

a plurality of portable communicators, each of which includes a circuit, a microphone, and a speaker that cooperate to communicate voice content;

a plurality of assets, each of which is tagged with an active radio-frequency ID responder; and a processor that cooperates with the communicators and the responders to determine locations of the responders to within 1 meter.

14. The system of claim 13, wherein the system is implemented at a site of a first business, and the processor is local to the site.

15. The system of claim 13, wherein the system is implemented at a site of a first business, and the processor is distal to the site.

16. The system of claim 15, wherein the first business comprises a hospital.

17. The system of claim 13, wherein the system is implemented at a site of a first business, and the processor is operated by a second business that is located distal to the site of the first business.

18. The system of claim 13, further comprising software operating on the processor that reports to at least one of the plurality of communicators the location of at least one of the responders as being within one of a plurality of business locations.

19. The system of claim 13, further comprising software operating in a server that consolidates output from a first and second different middleware.

20. The system of claim 13, further comprising software operating in a server that uses scalar vector graphics to display the locations with varying degrees of detail on a display.

21. The system of claim 13, further comprising software operating in a communicator that displays replay of movements of the assets.

22. The system of claim 13, further comprising software operating in a communicator that displays utilization profiles of the assets.

23. The system of claim 13, wherein at least one of the responders contains memory that can store information communicated orally from a user through the communicator.

24. The system of claim 13, wherein at least one of the responders cooperates with the communicator to effect voice-to-write status and voice-to-read status.

25. The system of claim 13, further comprising a subsystem that coordinates the locations of at least some of the plurality of assets with data from a global satellite positioning system (GPS).

* * * * *